US007304655B2

(12) United States Patent
Choi et al.

(10) Patent No.: US 7,304,655 B2
(45) Date of Patent: Dec. 4, 2007

(54) IMAGE DISPLAY APPARATUS

(75) Inventors: Jin-Hyun Choi, Suwon (KR); Choon-Yul Oh, Gunpo (KR); Jae-Sung Lee, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 512 days.

(21) Appl. No.: 10/734,674

(22) Filed: Dec. 15, 2003

(65) Prior Publication Data

US 2004/0164938 A1 Aug. 26, 2004

(30) Foreign Application Priority Data

Feb. 20, 2003 (KR) ..... 10-2003-0010665

(51) Int. Cl.
*G09G 5/10* (2006.01)

(52) U.S. Cl. ..... 345/690; 345/204

(58) Field of Classification Search ..... 345/63, 345/77, 89, 102, 204, 690, 589, 82
See application file for complete search history.

(56) References Cited

U.S. PATENT DOCUMENTS 4,489,349 A * 12/1984 Okada ..... 348/674
5,734,362 A * 3/1998 Eglit ..... 345/89
6,795,053 B1 * 9/2004 Funamoto et al. ..... 345/102
2002/0180754 A1 * 12/2002 Suzuki ..... 345/598
2003/0103058 A1 * 6/2003 Hellen Brown Elliott et al. ..... 345/589
2003/0151565 A1 * 8/2003 Kim et al. ..... 345/60
2003/0184500 A1 * 10/2003 Kang ..... 345/60
2004/0234153 A1 * 11/2004 Nakami ..... 382/254

FOREIGN PATENT DOCUMENTS

| | | |
|---|---|---|
| JP | 11-305734 | 11/1999 |
| JP | 2000-115802 | 4/2000 |
| JP | 2002-116728 | 4/2002 |
| JP | 2002-142133 | 5/2002 |
| JP | 2002-333858 | 11/2002 |

* cited by examiner

*Primary Examiner*—Ricardo Osorio
(74) *Attorney, Agent, or Firm*—H.C. Park & Associates, PLC

(57) ABSTRACT

An image display apparatus with pixels where each of the pixels has a light emitting element such as an organic EL (electro-luminescence) element. The brightness of the light emitting element is controlled by the current flowing in the light emitting element. The image display apparatus adjusts the amplitude of the white gray levels in accordance with average brightness of a screen displayed by RGB data.

12 Claims, 2 Drawing Sheets

IMAGE DISPLAY APPARATUS

CROSS REFERENCE TO RELATED APPLICATION

This application is based on Korean Patent Application No. 10-2003-0010665 filed on Feb. 20, 2003, in the Korean Intellectual Property Office, the content of which is incorporated herein by reference in its entirety.

BACKGROUND OF THE INVENTION (a) Field of the Invention

The invention relates to an image display apparatus having pixels where the brightness of each pixel is controlled by a display signal. More specifically, the invention relates to an image display apparatus having pixels where a light emitting element such as an organic EL (electroluminescence) element is provided with each pixel and the brightness of the light emitting element is controlled by the amount of current flowing in the light emitting element. Moreover, the invention relates to an image display apparatus of an active matrix type where current supplied to a light emitting element is controlled by an active device, such as an insulating gate type FET (field effect transistor), which is provided in each pixel.

(b) Description of the Related Art

In general, a plurality of pixels are arranged in a matrix in an active matrix type image display apparatus, and an image is displayed by controlling the light intensity of each pixel in accordance with the brightness information provided from an external graphic source.

An organic EL image display apparatus is a self-emitting display by having a plurality of pixels and each of pixels having a light emitting element such as an OLED (organic light emitting diode). Organic EL image display apparatus are advantageous in comparison with a liquid crystal display because organic EL image display apparatus have favorable visibility, do not require a backlight, and they have a high display response speed. Brightness of each light emitting element is controlled by controlling the amount of current flowing in each light emitting element. In other words, the organic EL image display apparatus has a different property from the liquid crystal display in that the brightness of each light emitting element in the organic EL image display apparatus is directly controlled by the current flowing in each light emitting element, while the brightness of each pixel in the liquid crystal display is indirectly controlled by a light emitting means such as a backlight.

There are two general driving methods for driving organic EL image display apparatus. There is a passive matrix driving method and an active matrix driving method. The passive matrix driving method enables a simple panel structure in a display apparatus, but has difficulty realizing a large panel size and high definition of a display apparatus. Thus, a display apparatus using the active matrix driving method has been developed. In an organic EL image display apparatus using the active matrix driving method, current flowing in a light emitting element provided at each pixel is controlled by an active device provided at each pixel. The active device may be, for example, a thin film transistor which is a kind of an insulating gate type field effect transistor.

In a conventional organic EL image display apparatus configured as above, display operation is performed by a driving method where fixed gray levels regardless of brightness distribution by inputted RGB image data are used for display operation. That is, display operation is performed with fixed gray levels, and the display operation does not depend on whether the brightness of the display screen is high or low. The brightness of the display screen may be determined by the brightness distribution of RGB data. According to the above driving method, however, the brightness difference in a display screen becomes large when a difference between the number of ON-pixels and OFF-pixels is large. The brightness difference causes an uneven display in a screen. To solve the above problem, it is possible to reduce the steps of neighboring gray levels. However, this solution still has a problem of a representation limit due to a decrease of steps in neighboring gray levels. Thus, it is required that the steps of the neighboring gray levels should be variably adjusted in accordance with the brightness level of the display screen.

SUMMARY OF THE INVENTION

The invention provides an image display apparatus which may adjust steps of neighboring gray levels variably in accordance with a brightness level of a display screen.

The image display apparatus according to the invention includes a display panel having pixels arranged in a matrix and for performing a display operation, a scan driver for sequentially selecting pixel lines of the display panel, and a data driver for applying color signals to a corresponding pixel line when the pixel line of the display panel is selected. The display apparatus further includes a display controller for receiving color data and generating timing signals for controlling the drivers, while transforming the color data into analog signals and performing gamma correction to the transformed analog signals to generate color signals. The display controller determines reference data for brightness adjustment in accordance with an average brightness of a screen displayed by the color data and performs gamma correction by adjusting gray levels of the RGB data in accordance with the reference data for brightness adjustment.

According to the image display apparatus of the invention, an amplitude of the white gray levels may be adjusted in accordance with an average brightness of a screen displayed by color data. Thus, at least a problem of uneven display in a screen due to a brightness difference may be solved.

BRIEF DESCRIPTION OF THE DRAWINGS

The accompanying drawings, which are incorporated in and constitute a part of the specification, illustrate an exemplary embodiment of the invention, and, together with the description, serve to explain the principles of the invention.

DETAILED DESCRIPTION OF THE EXEMPLARY EMBODIMENTS

In the following detailed description, only the exemplary embodiment of the invention has been shown and described, simply by way of illustration of the best mode contemplated by the inventor(s) of carrying out the invention. As will be realized, the invention is capable of modification in various obvious respects, all without departing from the invention.

Accordingly, the drawings and description are to be regarded as illustrative in nature, and not restrictive.

Figure 1:
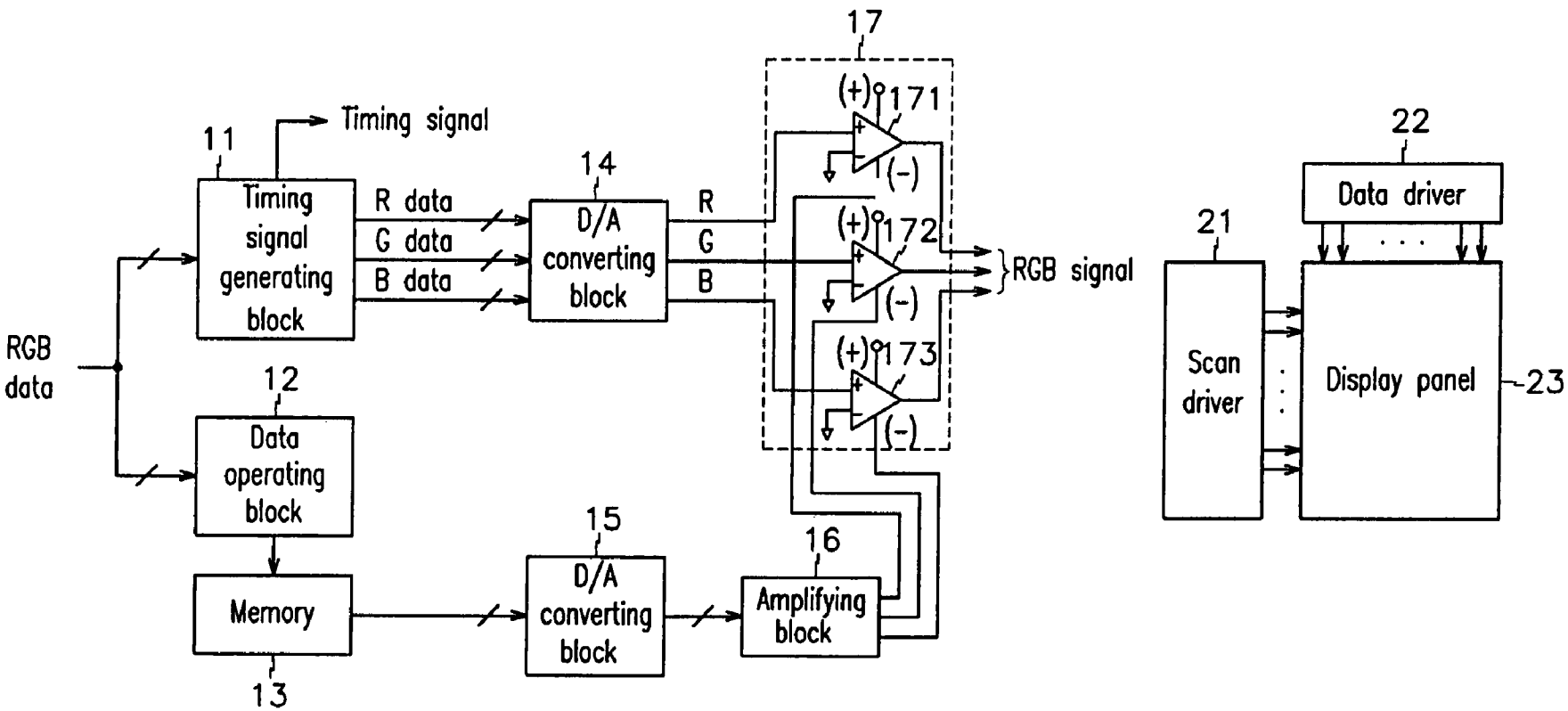
FIG. 1 illustrates overall block diagram of an image display apparatus in accordance with an exemplary embodiment of the invention.

FIG. 1 illustrates an overall block diagram of an image display apparatus in accordance with an embodiment of the invention.

As shown in FIG. 1, the image display apparatus of the exemplary embodiment comprises a timing signal generating block 11, a data operating block 12, a memory 13, D/A converting blocks 14 and 15, an amplifying block 16, a differential amplifying block 17, a scan driver 21, a data driver 22, and a display panel 23. The timing signal generating block 11, the data operating block 12, the memory 13, the D/A converting blocks 14 and 15, the amplifying block 16, and the differential amplifying block 17 operate as a display controller of the image display apparatus. The display controller configured as above receives RGB data and generates timing signals for controlling display operation of the display panel 23. Moreover, the display controller generates RGB signals for driving each pixel of the display panel 23 by using the inputted RGB data. In particular, the display controller may adjust steps of neighboring gray levels. More specifically, for example, the display controller may adjust the amplitude of white gray level, in accordance with the brightness level of a screen displayed by the RGB data. The brightness level may be regarded as the average brightness of a screen. In this exemplary embodiment, this function of adjusting steps of neighboring gray levels is performed by the data operating block 12, the memory 13, the D/A converting block 15, the amplifying block 16, and the differential amplifying block 17. It is of course possible to configure the image display apparatus such that the amplitude of white gray levels may be adjusted in units of each RGB color.

Next, operation of the image display apparatus will be described.

First, RGB data which is outputted from a graphic source outside of the image display apparatus, such as a mobile phone or a PDA (personal digital assistant) etc., is inputted into the timing signal generating block 11 and the data operating block 12. The data operating block 12 calculates the average brightness of one screen to be displayed by the RGB data, and outputs address information corresponding to the calculated average brightness. The memory 13 stores reference data for brightness adjustment as data information corresponding to the addresses of the memory 13. Thus, the reference data are matched with a value of the average brightness. Accordingly, the memory 13 outputs reference data for brightness adjustment in response to the address information outputted from the data operating block 12.

The reference data for brightness adjustment comprises red color components, green color components, and blue color components. In this embodiment, it is assumed that the reference data for the brightness adjustment corresponds to the average brightness value of one display screen. For example, when the average brightness has a high value, the reference data for brightness adjustment is set to be high. When the average brightness has a low value, the reference data for brightness adjustment is set to be low. Then, the white gray level of the RGB data is controlled by using the reference data for brightness adjustment. Then, RGB signals having adjusted brightness may be obtained. The display operation of the display panel 23 is performed by the above obtained RGB signals. Therefore, the brightness difference in a certain display screen due to a difference between the number of ON-pixels and OFF-pixels may be decreased because RGB signals are adjusted in accordance with the average brightness value of the screen regardless of the difference between the number of ON-pixels and OFF-pixels.

Meanwhile, the timing signal generating block 11 receives RGB data and generates timing signals for controlling the display operation of the display panel 23 by using the received is RGB data. The generated timing signals are commonly outputted to the scan driver 21 and the data driver 22. The scan driver 21 sequentially selects pixels of the display panel 23 in units of one pixel line. The data driver 22 performs a display operation by applying the RGB signals to the selected pixel line of the display panel 23. The timing signal generating block 11 transforms the data format of the inputted RGB data and outputs R data, G data, and B data. The D/A converting block 14 transforms the R data, G data, and B data outputted from the timing signal generating block 11 into analog signals, and then outputs the analog signals to the differential amplifying block 17.

The reference data for brightness adjustment outputted from the memory 13 is inputted to the D/A converting block 15, where it is transformed into analog signals. The analog signals outputted from the D/A converting block 15 are amplified in voltage level by the amplifying block 16, and outputted to the (−) voltage terminal of the differential amplifying block 17.

Figure 2:
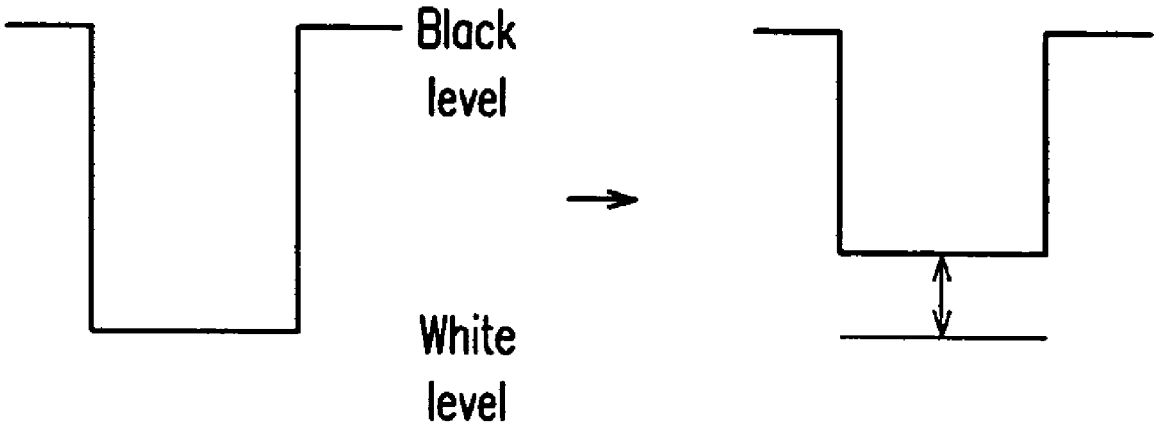
FIG. 2 illustrates brightness adjustment procedure of white level in the image display apparatus shown in FIG. 1.

The differential amplifying block 17 includes three differential amplifiers 171, 172, and 173 for processing signals corresponding to each color of red, green, and blue, respectively. As described above, the RGB signals from the D/A converting block 14 are inputted to the differential amplifying block 17 while the reference signal for brightness adjustment of the red, green, and blue colors is inputted to the differential amplifying block 17. Each of the differential amplifiers 171, 172, and 173 amplifies one corresponding color signal among the RGB signals. More particularly, each of the differential amplifiers 171, 172, and 173 receives an RGB analog signal and a reference signal for brightness adjustment and adjusts the white level of the corresponding color signal by using the received reference signal for brightness adjustment. As a result, the amplitude of the white level among the gray display levels, which is represented by the RGB analog signals, may be adjusted in accordance with the reference signal for brightness adjustment. FIG. 2 illustrates a varying width of the white level. Through the above described procedure, the gamma component of the RGB analog signal may be adjusted in accordance with the average brightness value of a display screen. The differential amplifying block 17 generates RGB signals having undergone gamma correction, and the RGB signals are provided to the data driver 22. The data driver 22 applies the RGB signals to the display panel 23.

In the image display apparatus described above, a driver of a voltage driving type has been used as the data driver 22, but the technical range of the invention is not limited to this point. However, it should be understood by one of ordinary skill in the art that a driver of a current driving type may be used as the data driver 22. In this case, the memory 13 in FIG. 1 may be excluded and the output signal of the data operating block 12 is directly inputted to the D/A converting block 15.

As described above, the image display apparatus of the invention may adjust amplitude of the white gray levels in accordance with average brightness of a screen displayed by RGB data. Thus, a problem of uneven display in a screen due to a brightness difference may be solved.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An image display apparatus, comprising:

a display panel having pixels arranged in a matrix and for performing a display operation;

a scan driver for sequentially selecting pixel lines of the display panel;

a data driver for applying color signals to a corresponding pixel line when the pixel line of the display panel is selected; and a display controller for receiving color data and generating timing signals for controlling the scan driver and the data driver, while transforming the color data into analog signals and performing gamma correction to the transformed analog signals to generate the color signals, wherein the display controller determines reference data for brightness adjustment in accordance with an average brightness of a screen displayed by the RGB data, and performs gamma correction by adjusting gray levels of the RGB data in accordance with the reference data for brightness adjustment, wherein the color signals are RGB signals, and the color data is RGB data, wherein the display controller comprises:

a timing signal generating block for generating timing signals for controlling the scan driver and the data driver by using the received RGB data and transforming a data format of the RGB data;

a data operating block for calculating average brightness of a screen displayed by the received RGB data and outputting address information corresponding to the calculated average brightness;

a memory for storing reference data for brightness adjustment as data information corresponding to addresses, the reference data being matched with the calculated average brightness, and outputting reference data for brightness adjustment in response to the address information outputted from the data operating block;

a D/A converting means for transforming the RGB data outputted from the timing signal generating block and the reference data for brightness adjustment into analog signals;

an amplifying block for amplifying the analog signals of the reference data for brightness adjustment outputted from the D/A converting means; and a differential amplifying block for controlling white level of the RGB data by using analog signals of the RGB data and the reference data for brightness adjustment and generating RGB signals.

2. The image display apparatus according to claim 1, wherein the RGB data inputted to the display controller are provided from a graphic controller of a mobile telephone or a PDA outside the image display apparatus.

3. The image display apparatus according to claim 1, wherein the reference data for brightness adjustment comprises of red color components, green color components, and blue color components.

4. The image display apparatus according to claim 1, wherein the reference data for brightness adjustment is set to be high when the average brightness of a screen has a high value and is set to be low when the average brightness of a screen has a low value.

5. The image display apparatus according to claim 1, wherein the differential amplifying block includes a differential amplifier for each of the red color component, green color component and blue color component and each of the differential amplifiers processes the color component associated therewith.

6. The image display apparatus according to claim 1, wherein the differential amplifying block adjusts the white level of the RGB signal by controlling the RGB signals with the analog signals of the reference data for brightness adjustment.

7. An image display apparatus, comprising:

a timing signal generating block for generating a timing signal for controlling a scan driver and a data driver by using inputted RGB data and transforming a data format of the inputted RGB data;

a data operating block for calculating an average brightness of a screen displayed by the inputted RGB data and outputting address information corresponding to the calculated average brightness;

a memory for storing reference data for brightness adjustment as data information corresponding to addresses, the reference data being matched with the calculated average brightness, and outputting reference data for brightness adjustment in response to the address information outputted from the data operating block;

a D/A converting means for transforming the RGB data outputted from the timing signal generating block and the reference data for brightness adjustment into analog signals;

an amplifying block for amplifying the analog signal of the reference data for brightness adjustment outputted from the D/A converting means; and a differential amplifying block for controlling white level of the RGB data by using analog signals of the RGB data and the reference data for brightness adjustment and generating RGB signals.

8. The image display apparatus according to claim 7, wherein the reference data for brightness adjustment comprises red color components, green color components, and blue color components.

9. The image display apparatus according to claim 7, wherein the reference data for brightness adjustment is set to be high where the average brightness of a screen has a high value and is set to be low where the average brightness of a screen has a low value.

10. The image display apparatus according to claim 7, wherein the differential amplifying block includes a differential amplifiers for each color component.

11. The image display apparatus according to claim 10, where there is a red color component, a green color component and a blue color component.

12. The image display apparatus according to claim 7, wherein the differential amplifying block adjusts the white level of the RGB signal by controlling the RGB signal with the analog signal of the reference data for brightness adjustment.

* * * * *